US011569031B2

(12) United States Patent
Wang et al.

(10) Patent No.: US 11,569,031 B2
(45) Date of Patent: Jan. 31, 2023

(54) METHOD FOR MANUFACTURING PLANAR TRANSFORMER WITH ODD TURN RATIO

(71) Applicant: Tianjin University, Tianjin (CN)

(72) Inventors: Yifeng Wang, Tianjin (CN); Bo Chen, Tianjin (CN); Xiaoyong Ma, Tianjin (CN); Mengying Chen, Tianjin (CN); Zhongjie Wang, Tianjin (CN); Chen Chen, Tianjin (CN)

(73) Assignee: Tianjin University, Tianjin (CN)

( * ) Notice: Subject to any disclaimer, the term of this patent is extended or adjusted under 35 U.S.C. 154(b) by 182 days.

(21) Appl. No.: 17/198,827

(22) Filed: Mar. 11, 2021

(65) Prior Publication Data

US 2022/0208448 A1 Jun. 30, 2022

(30) Foreign Application Priority Data

Dec. 28, 2020 (CN) ..... 202011577673.5

(51) Int. Cl.
*H01F 41/04* (2006.01)
*H01F 27/28* (2006.01)

(52) U.S. Cl.
CPC ..... *H01F 41/041* (2013.01); *H01F 27/2804* (2013.01); *H01F 2027/2819* (2013.01)

(58) Field of Classification Search
CPC ..... H01F 27/2804; H01F 41/041; H01F 2027/2819
See application file for complete search history.

(56) References Cited

U.S. PATENT DOCUMENTS 3,483,499 A * 12/1969 Lugten ..... H01F 27/2804 336/200
3,765,082 A * 10/1973 Zyetz ..... H01F 41/046 336/200
3,833,872 A * 9/1974 Marcus ..... H01F 41/046 336/200
5,126,714 A * 6/1992 Johnson ..... H01F 19/04 336/200
5,952,909 A * 9/1999 Umeno ..... H01F 41/043 336/232
6,000,128 A * 12/1999 Umeno ..... H01F 41/043 336/200
10,002,707 B2 * 6/2018 Tsai ..... H01F 27/2871

* cited by examiner

*Primary Examiner* — Carl J Arbes
(74) *Attorney, Agent, or Firm* — McCarter & English, LLP; Michael J. DeGrazia; Xiaoyuan Ding

(57) ABSTRACT

A method for planar transformer with an odd turn ratio includes: determining a turn ratio and winding parameters of a transformer to be manufactured; if the turn ratio is odd, determining that there is respectively one winding turn on a first middle layer and a second middle layer and two winding turns on a top layer and a bottom layer; determining widths of winding wires on marginal layers as well as widths of winding wires on middle layers; winding and parallelly connecting an inner winding wire on the top layer to an inner winding wire on the bottom layer, and then serially connecting the parallel-connected inner winding wires to an outer winding wire to form a primary winding; and parallelly connecting the winding wire on the first middle layer to the winding wire on the second middle layer to form a secondary winding, so as to obtain the transformer.

7 Claims, 3 Drawing Sheets

METHOD FOR MANUFACTURING PLANAR TRANSFORMER WITH ODD TURN RATIO

CROSS-REFERENCE TO RELATED APPLICATION

This Application claims priority to Chinese Patent Application No. 202011577673.5, filed on Dec. 28, 2020, the entire contents of which are incorporated herein by reference.

TECHNICAL FIELD

The present disclosure relates to the technical field of design of planar transformers, in particular to a method for manufacturing a planar transformer with an odd turn ratio.

BACKGROUND

In recent years, scientific and technological advances bring continuous improvement of power electronics. Isolation transformers have been widely used in the fields of new energy and distributed generation. Furthermore, with continuous improvement of magnetic integration, planar transformers have received more extensive attention on the aspects of application and technical research. The winding of most planar transformers is performed on printed circuit boards (PCBs), and single-layer winding or asymmetric multi-layer winding are generally adopted in a case of odd turn ratio. Such traditional winding modes require a large window area of magnetic cores or an increase in layers of the PCBs. As a result, the volume and design cost of the transformers are increased. Besides, asymmetric structures such as 2+1 structures will be caused by multi-layer structures in most cases. This may affect the distribution of magnetic fields of the transformers, and reduce the efficiency of the transformers.

When a planar transformer with an odd turn ratio is manufactured, asymmetry of the magnetic fields and low operating efficiency will be caused by the traditional winding modes.

SUMMARY

The present disclosure aims to provide a method for manufacturing a planar transformer with an odd turn ratio. In this method, inner winding wires are connected in parallel and then are connected in series to an outer winding wire which is not as wide as the inner winding wires, so as to form a primary winding; and in this way, a well-distributed magnetic field can be generated, so that operating efficiency of the planar transformer can be improved.

To achieve the above objective, the present disclosure provides the following solutions:

A method for manufacturing a planar transformer with an odd turn ratio includes:

determining a turn ratio and winding parameters of a transformer to be manufactured, where the winding parameters include a radius of a magnetic core, a length of a coil layout window, a winding resistance, and a winding thickness, and the transformer to be manufactured has a four-layer PCB including a bottom layer, a first middle layer, a second middle layer, and a top layer which are sequentially arranged from bottom to top;

if the turn ratio is odd, determining that there is respectively one winding turn on the first middle layer and the second middle layer and two winding turns on the top layer and the bottom layer;

determining widths of inner winding wires and outer winding wires on marginal layers as well as widths of winding wires on middle layers according to the winding parameters, where the marginal layers include the top layer and the bottom layer, and the middle layers include the first middle layer and the second middle layer;

winding according to the number of winding turns on the marginal layers and the middle layers, the widths of the inner winding wires and outer winding wires on the marginal layers, and the widths of the winding wires on the middle layers; parallelly connecting the inner winding wires on the top layer to the inner winding wire on the bottom layer, and then serially connecting the parallel-connected inner winding wires to an outer winding wire, so as to form a primary winding; and parallelly connecting the winding wire on the first middle layer to the winding wire on the second middle layer to form a secondary winding, so as to obtain the transformer winding; where the outer winding wire is formed by serially connecting the outer winding wire on the top layer to the outer winding wire on the bottom layer.

According to specific embodiments, the present disclosure has the following technical effects:

The method for manufacturing a planar transformer with an odd turn ratio includes: if the turn ratio is odd, determining that there is respectively one winding turn on the first middle layer and the second middle layer and two winding turns on the top layer and the bottom layer; winding according to the number of winding turns on the marginal layers and the middle layers as well as the widths of the inner winding wires and outer winding wires on the marginal layers and the widths of the winding wires on the middle layers, which are determined according to the winding parameters; meanwhile, parallelly connecting the inner winding wire on the top layer to the inner winding wire on the bottom layer, and then serially connecting the parallel-connected inner winding wires to the outer winding wire formed by serially connecting the outer winding wire on the top layer to the outer winding wire on the bottom layer, so as to form the primary winding; and parallelly connecting the winding wire on the first middle layer to the winding wire on the second middle layer to form the secondary winding, so as to obtain the transformer. In this method, the inner winding wires are parallelly connected to each other and then are serially connected to the outer winding wire which is not as wide as the inner winding wires, so as to form the primary winding; and in this way, operating efficiency of the planar transformer can be improved.

BRIEF DESCRIPTION OF DRAWINGS

For the sake of a clearer explanation of the technical solutions of the embodiments of the present disclosure or the prior art, the accompanying drawings required by the embodiments will be described briefly below. Clearly, the following accompanying drawings merely illustrate some embodiments of the present disclosure, and other accompanying drawings can also be obtained by those ordinarily skilled in the art based on the following ones without creative efforts.

In the figure, 1. inner winding wire on a top layer, 2. first through hole, 3. second through hole, 4. inner winding wire on a bottom layer, 5. winding wire on a first middle layer, 6. third through hole, 7. fourth through hole, 8. winding wire on a second middle layer, 9. outer winding wire on the top layer, 10. outer winding wire on the bottom layer.

DETAILED DESCRIPTION

The technical solutions of the embodiments of the present disclosure are clearly and completely described below with reference to the accompanying drawings. Apparently, the embodiments in the following descriptions are only illustrative ones, and are not all possible ones of the present disclosure. All other embodiments obtained by those ordinarily skilled in the art based on the embodiments of the present disclosure without creative efforts should also fall within the protection scope of the present disclosure.

The objective of the present disclosure is to provide a method for manufacturing a planar transformer with an odd turn ratio. In this method, inner winding wires are parallelly connected to each other and then are serially connected to an outer winding wire which is not as wide as the inner winding wires, so as to form a primary winding; and in this way, operating efficiency of the planar transformer can be improved, and such winding mode can be applied to the technical field of design of planar transformers.

To make the objectives, features, and advantages of the present disclosure more obvious and understandable, the following further describes in detail the present disclosure with reference to the accompanying drawings and specific implementations.

Figure 1:
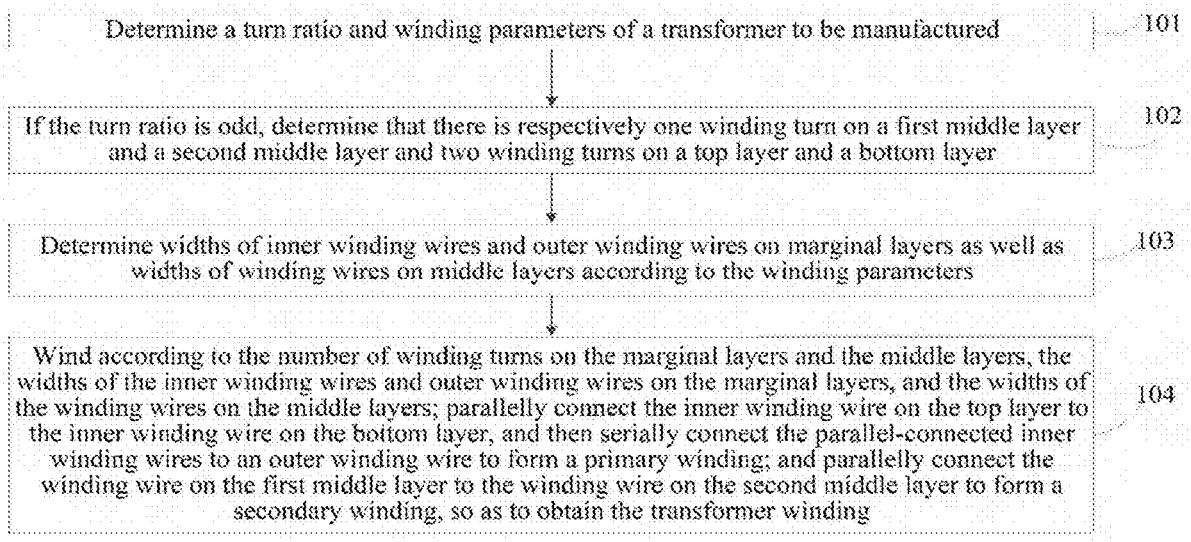
FIG. 1 is a flow chart of a method for manufacturing a planar transformer with an odd turn ratio in an embodiment of the present disclosure.
Figure 2:
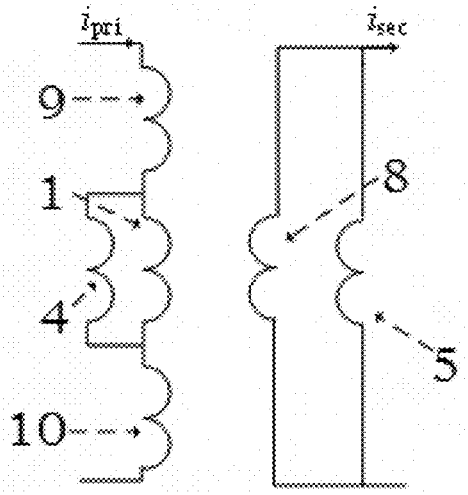
FIG. 2 is a structural diagram of a primary winding and a secondary winding in the embodiment of the present disclosure.

FIG. 1 shows a flow chart of the method for manufacturing a planar transformer with an odd turn ratio in an embodiment of the present disclosure. As shown in FIG. 1, the method for manufacturing a planar transformer with an odd turn ratio includes:

Step 101: determine a turn ratio and winding parameters of a transformer to be manufactured, where the winding parameters include a radius of a magnetic core, a length of a coil layout window, a winding resistance, and a winding thickness, and the transformer to be manufactured has a four-layer PCB including a bottom layer, a first middle layer, a second middle layer, and a top layer which are sequentially arranged from bottom to top; and Determine a winding mode according to the turn ratio, where a traditional method will be implemented to manufacture the transformer if the turn ratio is even, and step 102, step 103, and step 104 will be performed if the turn ratio is odd;

Step 102: if the turn ratio is odd, determine that there is respectively one winding turn on the first middle layer and the second middle layer and two winding turns on the top layer and the bottom layer;

Step 103: determine widths of inner winding wires and outer winding wires on marginal layers as well as widths of winding wires on middle layers according to the winding parameters, where the marginal layers include the top layer and the bottom layer, and the middle layers include the first middle layer and the second middle layer; and Step 104: wind according to the number of winding turns on the marginal layers and the middle layers, the widths of the inner winding wires and outer winding wires on the marginal layers, and the widths of the winding wires on the middle layers; parallelly connect the inner winding wire on the top layer to the inner winding wire on the bottom layer, and then serially connect the parallel-connected inner winding wires to an outer winding wire, so as to form a primary winding; and parallelly connect the winding wire on the first middle layer to the winding wire on the second middle layer to form a secondary winding, so as to obtain the transformer, where the outer winding wire is formed by serially connecting the outer winding wire on the top layer to the outer winding wire on the bottom layer.

FIG. 2 to FIG. 7 show the bottom layer, first middle layer, second middle layer, top layer, primary winding, and secondary winding of the obtained transformer. Where, the inner winding wire 1 on the top layer is parallelly connected to the inner winding wire 4 on the bottom layer via a first through hole 2 and a second through hole 3, and then the parallel-connected inner winding wires are serially connected to the outer winding wire formed by serially connecting the outer winding wire 9 on the top layer to the outer winding wire 10 on the bottom layer, so as to form the primary winding; and the winding wire 5 on the first middle layer is parallelly connected to the winding wire 8 on the second middle layer via a third through hole 6 and a fourth through hole 7 to form the secondary winding. Furthermore, the obtained transformer is formed with the first through hole 2 in the top layer, the second through hole 3 in the bottom layer, the third through hole 6 in the first middle layer, and the fourth through hole 7 in the second middle layer; and $i_{pri}$ and $i_{sec}$ respectively represent currents flowing through the primary winding and secondary winding of the transformer.

In an optional embodiment, the step of determining a turn ratio and winding parameters of a transformer to be manufactured specifically includes:

Determine the turn ratio and the winding parameters according to an operating frequency and voltage transformation level of the transformer to be manufactured.

In an optional embodiment, the step of determining widths of inner winding wires and outer winding wires on marginal layers as well as widths of winding wires on middle layers according to the winding parameters specifically includes:

Determine the width of the inner winding wire on the top layer according to the winding parameters;

Determine the width of the outer winding wire on the top layer according to the radius of the magnetic core, the length of the coil layout window, and the width of the inner winding wire on the top layer;

Determine the width of the inner winding wire on the bottom layer according to the width of the inner winding wire on the top layer as well as the width of the outer winding wire on the bottom layer according to the width of the outer winding wire on the top layer; and Determine the width of the winding wire on the first middle layer and the width of the winding wire on the second middle layer according to the radius of the magnetic core and the length of the coil layout window.

In an optional embodiment, the step of determining the width of the inner winding wire on the top layer according to the winding parameters specifically includes:

Create a formula for calculating equivalent impedance as follows:

$$R_{total}=4\rho\pi r_1/[(r_1-r_0-x_1)h]+\rho\pi(r_0-x_1)/(x_1h);$$

Figure 3:
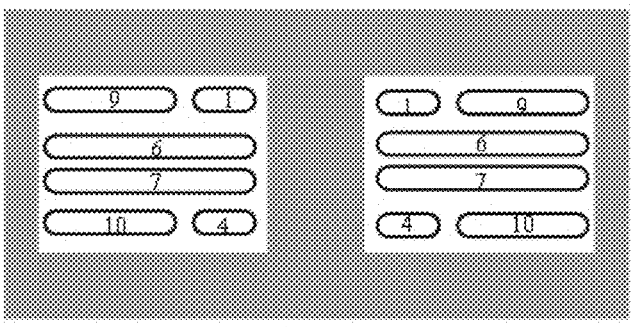
FIG. 3 is a top view of a top layer in the embodiment of the present disclosure.
Figure 4:
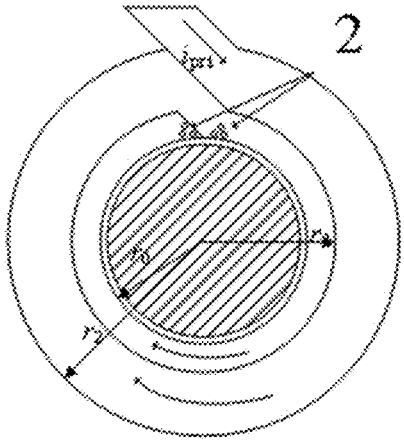
FIG. 4 is a top view of a bottom layer in the embodiment of the present disclosure.
Figure 5:
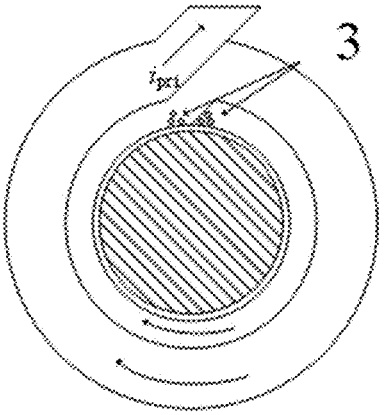
FIG. 5 is a top view of a first middle layer in the embodiment of the present disclosure.
Figure 6:
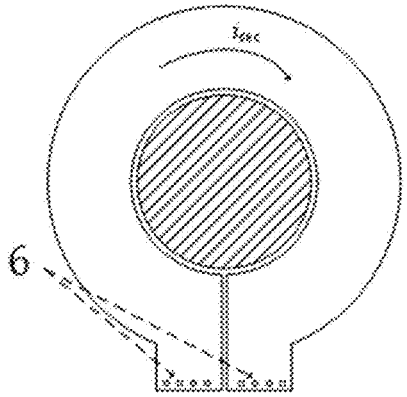
FIG. 6 is a top view of a second middle layer in the embodiment of the present disclosure.
Figure 7:
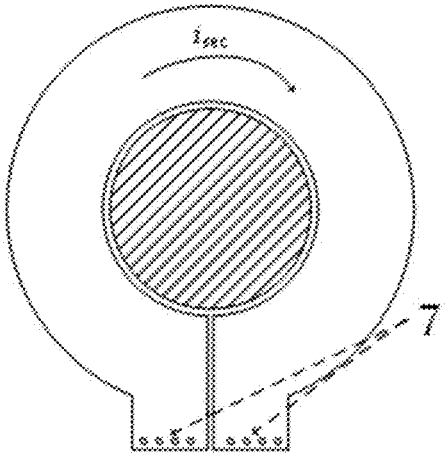
FIG. 7 is a sectional view of the primary winding and the secondary winding in the embodiment of the present disclosure.

Where, $R_{total}$ represents equivalent impedance of the primary winding; ρ represents the winding resistance; $r_1$ represents the length of the coil layout window; $r_0$ represents the radius of the magnetic core; $x_1$ represents the width of the inner winding wire on the top layer; and h represents the winding thickness; and as shown in FIG. 3, $x_1=r_2-r_0$;

Derive the formula for calculating the equivalent impedance to obtain a derivative formula; and Substitute the winding parameters into the derivative formula, and set a derivative of the equivalent impedance of the primary winding as zero, so as to obtain the width of the inner winding wire on the top layer. The formula for calculating the equivalent impedance is derived through the following steps:

Create a formula for calculating impedance of a parallel winding according to the radius of the magnetic core, the winding resistance, and the winding thickness as follows:

$$R_1=\rho\pi(r_0+x)/(xh).$$

Where, $R_1$ represents the impedance of the parallel winding;

Create a formula for calculating impedance of the outer winding wire according to the winding parameters as follows:

$$R_2=\rho 4\pi r_1/[(r_1-r_0-x)h];$$

Where, $R_2$ represents the impedance of the outer winding wire; and

Create the formula for calculating the equivalent impedance according to the formula for calculating the impedance of the parallel winding and the formula for calculating the impedance of the outer winding wire as follows:

$$R_{total}=R_1+R_2=4\rho\pi r_1/[(r_1-r_0-x_1)h]+\rho\pi(r_0+x_1)/(x_1h)$$

In an optimal embodiment, the width of the outer winding wire on the top layer is determined according to the radius of the magnetic core, the length of the coil layout window, and the width of the inner winding wire on the top layer specifically as follows:

$$y_1=r_1-r_0-x_1;$$

Where, $y_1$ represents the width of the outer winding wire on the top layer.

In an optimal embodiment, the width of the inner winding wire on the bottom layer is determined according to the width of the inner winding wire on the top layer and the width of the outer winding wire on the bottom layer is determined according to the width of the outer winding wire on the top layer as follows:

The inner winding wire on the bottom layer is as wide as the inner winding wire on the top layer, and the outer winding wire on the bottom layer is as wide as the outer winding wire on the top layer.

In an optimal embodiment, the width of the winding wire on the first middle layer and the width of the winding wire on the second middle layer are determined according to the radius of the magnetic core and the length of the coil layout window as follows:

$$x_2=x_3=r_1-r_0;$$

Where, $x_2$ represents the width of the winding wire on the first middle layer.

Each embodiment of the specification is described in a progressive manner, each embodiment focuses on the difference from other embodiments, and the same and similar portions of the embodiments may refer to each other.

Several specific embodiments are used to expound the principle and implementations of the present disclosure. The descriptions of these embodiments are used to assist in understanding the method of the present disclosure and its core conception. In addition, those ordinarily skilled in the art can make various modifications in terms of specific embodiments and scope of application based on the conception of the present disclosure. In conclusion, the content of this specification should not be construed as a limitation to the present disclosure.

What is claimed is:

1. A method for manufacturing a planar transformer with an odd turn ratio, comprising:

determining a turn ratio and winding parameters of a transformer to be manufactured, wherein the winding parameters comprise a radius of a magnetic core, a length of a coil layout window, a winding resistance, and a winding thickness, and the transformer to be manufactured has a four-layer printed circuit board (PCB) comprising a bottom layer, a first middle layer, a second middle layer, and a top layer which are sequentially arranged from bottom to top;

if the turn ratio is odd, determining that there is respectively one winding turn on the first middle layer and the second middle layer and two winding turns on the top layer and the bottom layer;

determining widths of inner winding wires and outer winding wires on marginal layers as well as widths of winding wires on middle layers according to the winding parameters, wherein the marginal layers comprise the top layer and the bottom layer, and the middle layers comprise the first middle layer and the second middle layer; and winding according to the number of winding turns on the marginal layers and the middle layers, the widths of the inner winding wires and outer winding wires on the marginal layers, and the widths of the winding wires on the middle layers; parallelly connecting the inner winding wire on the top layer to the inner winding wire on the bottom layer, and then serially connecting the parallel-connected inner winding wires to an outer winding wire, so as to form a primary winding; and parallelly connecting the winding wire on the first middle layer to the winding wire on the second middle layer to form a secondary winding, so as to obtain the transformer; wherein the outer winding wire is formed by serially connecting the outer winding wire on the top layer to the outer winding wire on the bottom layer.

2. The method for manufacturing a planar transformer with an odd turn ratio according to claim 1, wherein the step of determining a turn ratio and winding parameters of a transformer to be manufactured specifically comprises:

determining the turn ratio and the winding parameters according to an operating frequency and voltage transformation level of the transformer to be manufactured.

3. The method for manufacturing a planar transformer with an odd turn ratio according to claim 1, wherein the step of determining widths of inner winding wires and outer winding wires on marginal layers as well as widths of winding wires on middle layers according to the winding parameters specifically comprises:

determining the width of the inner winding wire on the top layer according to the winding parameters;

determining the width of the outer winding wire on the top layer according to the radius of the magnetic core, the length of the coil layout window, and the width of the inner winding wire on the top layer;

determining the width of the inner winding wire on the bottom layer according to the width of the inner winding wire on the top layer as well as the width of the outer winding wire on the bottom layer according to the width of the outer winding wire on the top layer; and determining the width of the winding wire on the first middle layer and the width of the winding wire on the second middle layer according to the radius of the magnetic core and the length of the coil layout window.

4. The method for manufacturing a planar transformer with an odd turn ratio according to claim 3, wherein the step of determining the width of the inner winding wire on the top layer according to the winding parameters specifically comprises:

creating a formula for calculating equivalent impedance as follows:

$$R_{total}=4\rho\pi r_1/[(r_1-r_0-x_1)h]+\rho\pi(r_0-x_1)/(x_1h);$$

wherein, $R_{total}$ represents equivalent impedance of the primary winding; ρ represents the winding resistance; $r_1$ represents the length of the coil layout window; $r_0$ represents the radius of the magnetic core; $x_1$ represents the width of the inner winding wire on the top layer; and h represents the winding thickness;

deriving the formula for calculating the equivalent impedance to obtain a derivative formula; and substituting the winding parameters into the derivative formula, and setting a derivative of the equivalent impedance of the primary winding as zero, so as to obtain the width of the inner winding wire on the top layer.

5. The method for manufacturing a planar transformer with an odd turn ratio according to claim 3, wherein the width of the outer winding wire on the top layer is determined according to the radius of the magnetic core, the length of the coil layout window, and the width of the inner winding wire on the top layer specifically as follows:

$$y_1=r_1-r_0-x_1;$$

wherein, $y_1$ represents the width of the outer winding wire on the top layer; $r_1$ represents the length of the coil layout window; $r_0$ represents the radius of the magnetic core; and $x_1$ represents the width of the inner winding wire on the top layer.

6. The method for manufacturing a planar transformer with an odd turn ratio according to claim 3, wherein the width of the inner winding wire on the bottom layer is determined according to the width of the inner winding wire on the top layer and the width of the outer winding wire on the bottom layer is determined according to the width of the outer winding wire on the top layer as follows:

the inner winding wire on the bottom layer is as wide as the inner winding wire on the top layer, and the outer winding wire on the bottom layer is as wide as the outer winding wire on the top layer.

7. The method for manufacturing a planar transformer with an odd turn ratio according to claim 3, wherein the width of the winding wire on the first middle layer and the width of the winding wire on the second middle layer are determined according to the radius of the magnetic core and the length of the coil layout window as follows:

$$x_2=x_3=r_1-r_0;$$

wherein, $x_2$ represents the width of the winding wire on the first middle layer; $x_3$ represents the width of the winding wire on the second middle layer; $r_1$ represents the length of the coil layout window; and $r_0$ represents the radius of the magnetic core.

* * * * *